US005702202A

United States Patent [19]

Schleiter

[11] Patent Number: 5,702,202

[45] Date of Patent: Dec. 30, 1997

[54] LAYING BEAM FOR A ROAD FINISHER

[75] Inventor: Burkhard Schleiter, Lütjensee, Germany

[73] Assignee: Svedala Strassenfertiger GmbH, Wardenburg, Germany

[21] Appl. No.: 587,518

[22] Filed: Jan. 17, 1996

[30] Foreign Application Priority Data

Jan. 17, 1995 [DE] Germany ..... 195 01 254.2

[51] Int. Cl.[6] ..... E01C 19/22

[52] U.S. Cl. ..... 404/118; 404/104

[58] Field of Search ..... 404/95, 104, 118, 404/119, 120

[56] References Cited

U.S. PATENT DOCUMENTS

| | | | |
|---|---|---|---|
| 4,345,852 | 8/1982 | Goto et al. | 404/118 X |
| 4,379,653 | 4/1983 | Brown | 404/118 |
| 4,502,813 | 3/1985 | Hojberg | 404/118 X |
| 4,678,365 | 7/1987 | Ban et al. | 404/104 X |

FOREIGN PATENT DOCUMENTS

| | | | |
|---|---|---|---|
| 7434220 | 1/1976 | Germany . | |
| 2448665 | 4/1976 | Germany . | |
| 3838158 | 5/1990 | Germany . | |
| 4208883 | 7/1993 | Germany . | |
| 560360 | 9/1993 | Germany . | |
| 1668521 | 8/1991 | U.S.S.R. | 404/118 |
| 2250529 | 6/1992 | United Kingdom | 404/118 |

*Primary Examiner*—James Lisehora

*Attorney, Agent, or Firm*—Sughrue, Mion, Zinn, Macpeak & Seas, PLLC

[57] ABSTRACT

For changing the working width of a road finisher, its laying beam (10) is composed of a (central) main beam (13) and two shifting beams (14). In the retracted state, the shifting beams (14) must have only an overall width which is not greater than that of the main beam (13). Furthermore, the working width of the laying beam (10) may be increased by extending the shifting beams (14) to twice the width of the main beam (13). In this case, there is no longer any overlap between the main beam (13) and the shifting beams (14), but the transition of the main beam (13) to the shifting beams (14) causes unsightly imprints on the finished road surfacing. This problem is solved by providing a laying beam (10) which, by offset projections (20, 21) on the shifting beams (14), forms an overlap between marginal regions of the shifting beams (14) and the main beam (13) when the shifting beams (14) are fully extended. This avoids unsightly imprints on the finished road surfacing. The offset of the projections (20, 21) in relation to one another allows the shifting beams (14) nevertheless to be retracted to such an extent that the overall width of the two retracted shifting beams (14) is not greater than the width of the main beam (13).

21 Claims, 4 Drawing Sheets

LAYING BEAM FOR A ROAD FINISHER

BACKGROUND OF THE INVENTION

The invention relates to a laying beam for a road finisher.

The working width of road finishers is usually increased by so-called shifting beams. For this purpose, the shifting beams are mounted such that they can be extended to the sides at opposite ends of a main beam. In practice, there is often the requirement to widen the laying beam to twice the width of the main beam, it having to be ensured however at the same time that, in the retracted state, the shifting beams do not protrude laterally beyond the main beam.

DE 38 38 158 A1 discloses a laying beam which makes it possible to extend the shifting beams to such an extent that the laying beam is twice the width of the basic beam. With fully extended shifting beams, the confronting end faces of the same finish flush with the outer end faces of the main beam. As a result, there is no overlapping of the extending beams with the main beam. This causes undesired seam-like imprints to be produced on the finished road surfacing.

SUMMARY OF THE INVENTION

Against this background, the invention is based on the object of providing a laying beam which ensures an overlapping of the shifting beams with the main beam and also twice the width of the main beam.

At least one projection on each of the confronting end faces of the shifting beams achieves the effect that the shifting beams have in certain regions a width which is greater than half the width of the main beam. This ensures an overlapping in certain regions of end regions of the main beam with corresponding end regions of the shifting beams even with fully extended shifting beams. An offset of each projection of the one shifting beam with respect to each projection of the other shifting beam brings about a toothed engagement of the projections of the two shifting beams when the shifting beams are fully retracted. On account of this, the shifting beams can be retracted to such an extent that they have altogether a width which does not go beyond the overall width of the main beam.

Preferably, each shifting beam has a plurality of projections, which follow one another at intervals for the formation of depressions between two neighbouring projections. Consequently, a projection is preferably followed—seen in the working direction—in each case by a depression. The projections of different shifting beams are offset with respect to one another in such a way that they are "staggered" in relation to one another. The projections of the one shifting beam can consequently engage in the depressions of the other shifting beam when the shifting beams are fully retracted. For this purpose, the projections are designed in a way corresponding to the depressions. Preferably, the depressions are dimensioned such that they are slightly larger than the projections, in order that the projections can engage freely in the depressions.

According to a preferred development of the invention, the depressions are bounded by in each case two projections. As a result, the front and rear sides of each shifting beam are assigned projections. The offset of the projections of neighbouring shifting beams is in this case achieved by an offset of the entire shifting beams with respect to each other, in that the one shifting beam is located in front of the other shifting beam, seen in the working direction.

In order to reduce the said offset of the shifting beams with respect to each other, according to a further proposal of the invention the front projection of the shifting beam offset forwards in the working direction has a smaller width than the other projections.

Furthermore, it is envisaged to provide at least those transverse edges of the projections which are at the front in the working direction of the road finisher with bevels which run obliquely to the underside of the projections. The bevels form ramp-like slopes, which serve the purpose of directing any road surfacing material which may accumulate ahead of the front transverse edges of the corresponding projections underneath these projections.

BRIEF DESCRIPTION OF THE DRAWING

A preferred exemplary embodiment of the laying beam according to the invention is explained in more detail below with reference to the drawing, in which.

DESCRIPTION OF A PREFERRED EMBODIMENT

Figure 1:
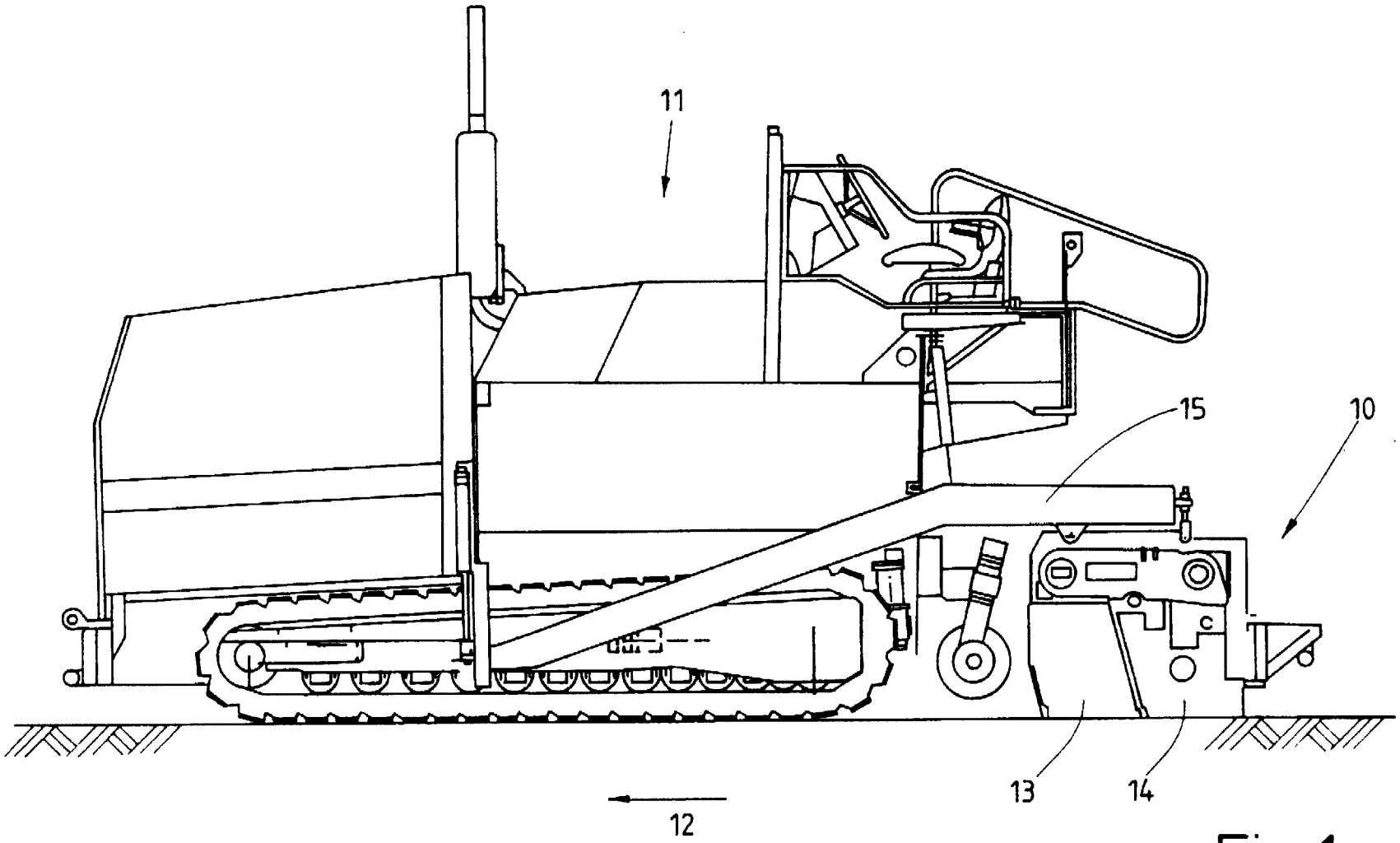
FIG. 1 shows a diagrammatic side view of a road finisher.

The invention concerns a laying beam 10 for a road finisher 11, shown in FIG. 1. The laying beam 10 is arranged—seen in the working direction 12—behind the road finisher 11.

Figure 2:
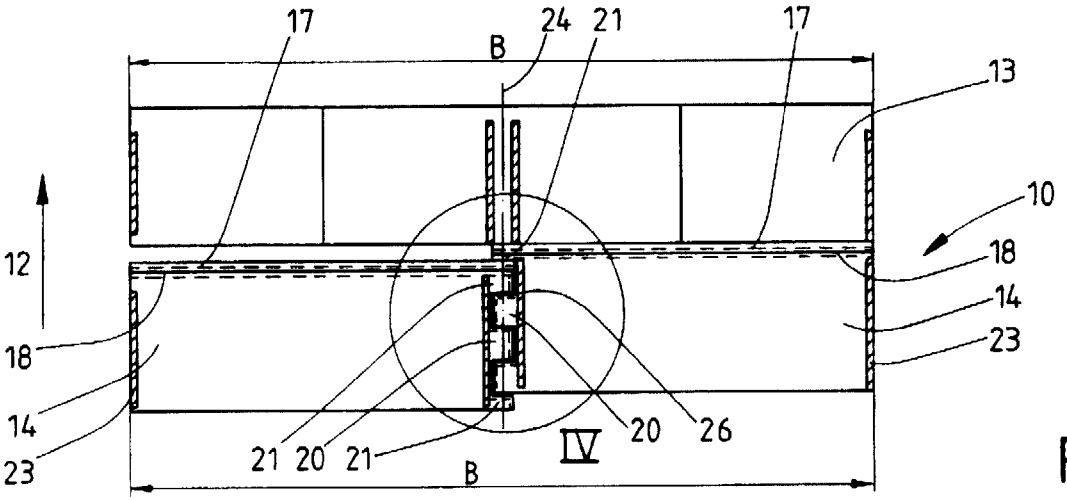
FIG. 2 shows a plan view of a laying beam of the road finisher with full retracted shifting beams.
Figure 3:
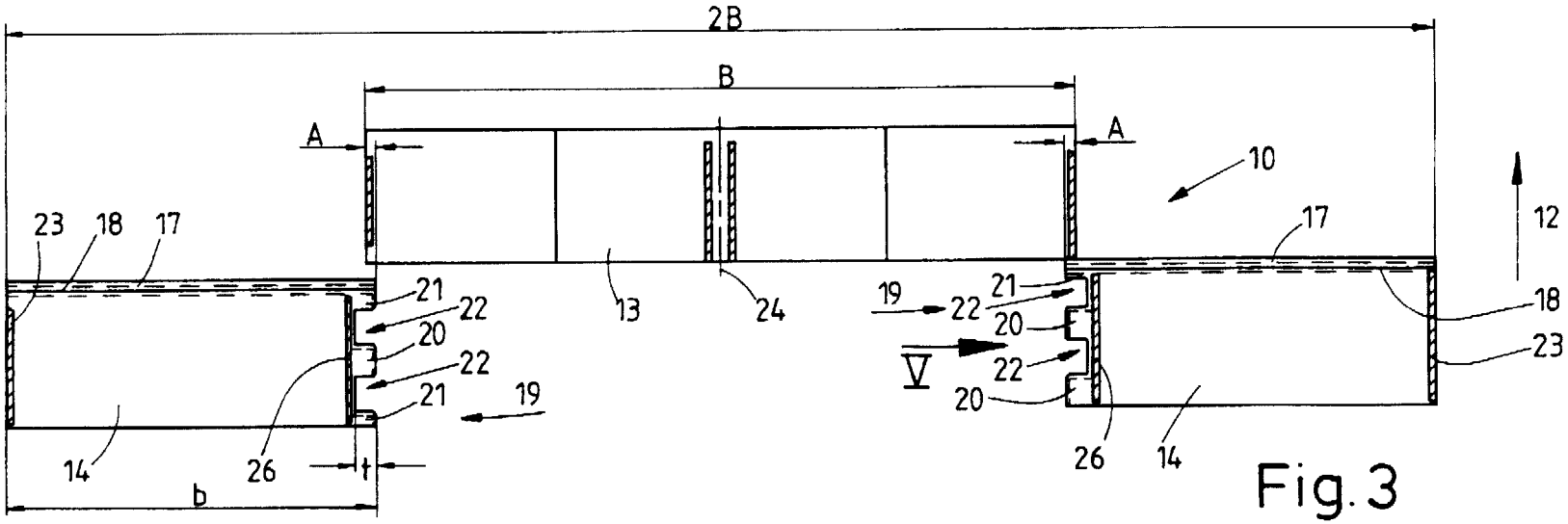
FIG. 3 shows the laying beam with fully extended shifting beams in a view analogous to FIG. 2.

The laying beam 10 is composed of a one-piece, or possibly centrally divided, main beam 13 and two shifting beams 14. For changing the working width of the laying beam 10, the shifting beams 14 are movable with respect to the main beam 13 in opposite directions transversely to the working direction 12 of the road finisher 11. In a starting position, shown in FIG. 2, with retracted shifting beams 14, the shifting beams 14 lie behind the main beam 13, so that the width of the two retracted shifting beams 14 corresponds to the width (B) of the main beam 13. FIG. 3 shows the laying beam 10 with fully extended shifting beams 14. The shifting beams 14 thereby increase the working width of the laying beam 10 to twice the width (B) of the main beam 13. According to the invention, there is at the same time an overlapping of end regions of the shifting beams 14 with end regions of the main beam 13, clearly visible in FIG. 3.

The laying beam 10 is suspended by the main beam 13 from the road finisher 11. Serving for this purpose are two supporting arms assigned to opposite sides of the road finisher 11, of which one supporting arm 15 can be seen in FIG. 1. The supporting arms 15 are movable up and down for raising and lowering the laying beam 10. In addition, by means not shown, the laying beam 10 can be tilted both longitudinally and transversely to the working direction 12.

The shifting beams 14 are mounted on the main beam 13 by guides (not shown in the figures). The shifting beams 14 can be extended and retracted in opposite directions along these guides by drives (likewise not shown), such as for example telescopic pressure-medium cylinders.

The main beam 13 and the shifting beams 14 are assigned tamper blades 17, which can be moved up and down in a vertical plane. In the figures, only the tamper blades 17 of the shifting beams 14 are shown. Each shifting beam 14 is assigned one plate-like upper blade 17, which is located in front of the corresponding shifting beam 14, seen in the working direction 12, and bears against an upright front wall 18 of the said shifting beam.

According to the invention, the confronting (inner) end faces 19 of the two shifting beams 14 are provided with projections 20. On each shifting beam 14, a plurality of projections 20, 21 follow one another at intervals in the working direction 12. As a result, depressions 22 are formed between in each case two neighbouring projections 20 and 21. Each depression 22 is bounded by two projections 20 and 21. The base area of each depression 22 corresponds approximately to the base area of the projections 20, of virtually the same size. Some of the projections 21 at the front side and/or rear side of each shifting beam are designed such that they are narrower than the other projections 20, for reasons still to be explained.

The depth (t) of the projections 20 and 21 and of the depressions 22, that is the direction of extent of the projections 20, 21 and of the depressions 22 transversely to the working direction 12, corresponds to twice the amount of an overlap (A) of a marginal region of the respective shifting beam 14 with the main beam 13, with shifting beams 14 fully extended to twice the width of the main beam (B). The width (b) of each shifting beam 14, that is the amount by which the outer end face 23 of the same is away from the free end of the projections 20, 21, corresponds to half the width (B/2) of the main beam plus half the depth (t/2) of the projections (20, 21) or depressions 22, thus half the width (B/2) of the main beam 13 plus the overlap (A).

The arrangement of the shifting beams 14 and of the projections 20, 21 and the depressions 22 is made such that the projections 20, 21 of the one shifting beam 14 engage in the depressions 22 of the other shifting beam, or some projections 21 lie in front of or behind the neighbouring shifting beam 14. With shifting beams 14 retracted into the starting position, the projections 20, 21 of neighbouring shifting beams 14 consequently engage in one another in a toothed manner. For this purpose, the depressions 22 are designed such that they are somewhat larger than the projections 21, 22. By the toothed engagement of the projections 20, 21 in corresponding depressions 22, the width (b) of the shifting beams is shortened, as it were, in the retracted state of the same, to be precise by the amount of the two overlaps (A), corresponding in each case to half the depth (t/2) of the projections 20, 21 and of the depressions 22. The front portions of the projections 20, 21 protruding beyond the longitudinal centre axis 24 of the laying beam 10 with the shifting beams 14 retracted, that is half the width (B/2) of the main beam 13, by the amount of the overlap (A) or half the depth (t/2) of the projections 20, 21, are thus accommodated in the depressions 22 of another shifting beam 14. This is clearly evident in particular from FIG. 4.

The shifting beams 14 are mounted on the main beam 13 such that they are offset in relation to each other with respect to the working direction 12. In the exemplary embodiment shown, the shifting beam 14 shown on the left in FIGS. 2 and 3 is located slightly behind the right-hand shifting beam 14. In this way, the projections 20, 21 of the shifting beams 14 are "staggered" in relation to one another, whereby the projections 20, 21 can engage in the corresponding depressions 22 when the shifting beams 14 are retracted. In the exemplary embodiment shown, the offset of the left-hand shifting beam 14 with respect to the right-hand shifting beam 14 corresponds to the width of the tamper blade 17 and of the following (front) side narrow projection 21. Accordingly, the amount of offset of the shifting beams 14 corresponds to the width of the rear side (narrow) projection 21 of the left-hand shifting beam 14. The width of the tamper blade 17 of the left-hand shifting beam 14 and of the following (narrow) projection 21 together corresponds to the width of one of the depressions 22 of the right-hand shifting beam 14.

Figure 4:
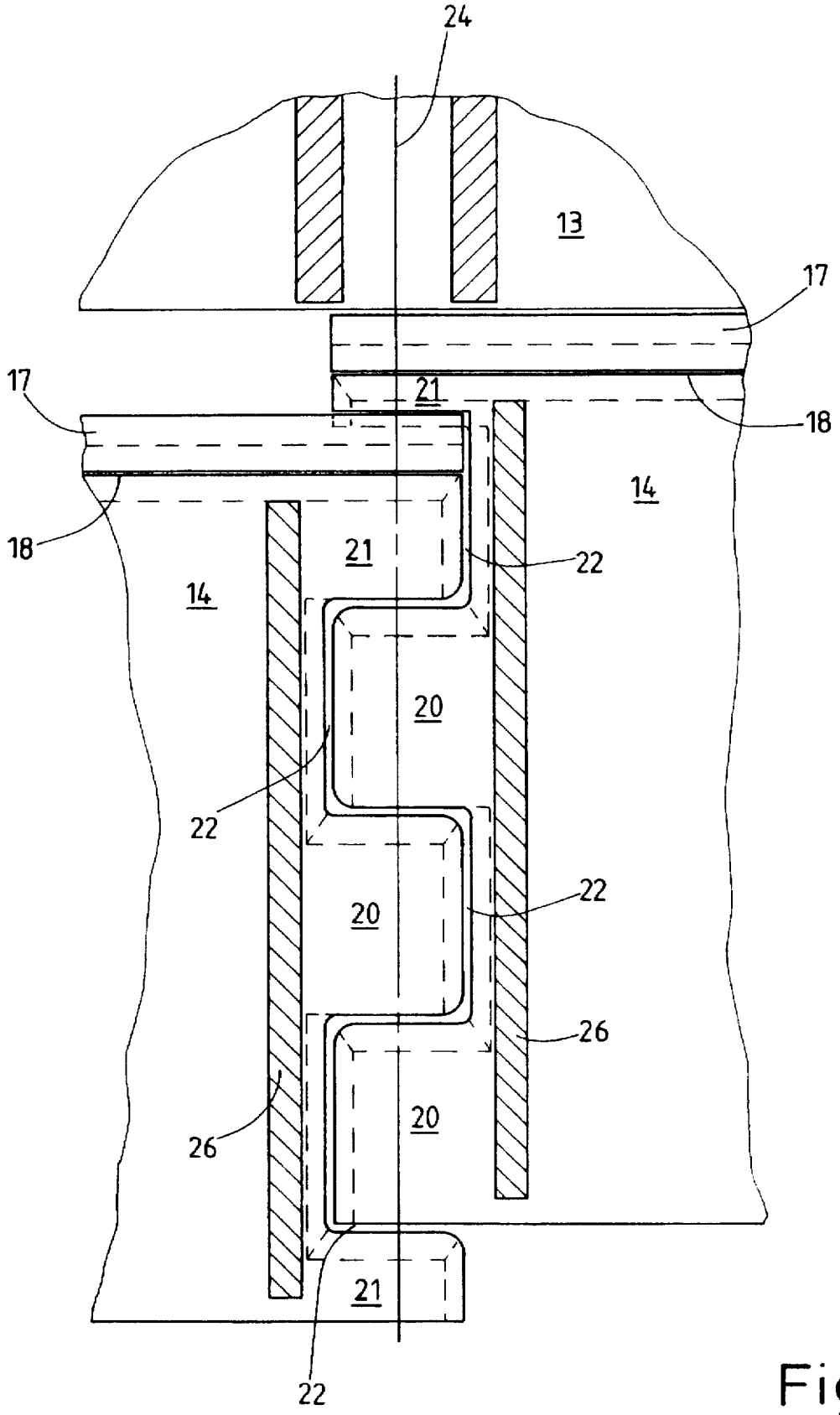
FIG. 4 shows an enlarged detail IV from FIG. 2.

The projections 20, 21 and depressions 22 on the confronting end faces 16 of the shifting beams 14 are located merely in a base plate 25 of the shifting beams 14. Conversely, upright end plates 26 on the confronting end faces 16 of the shifting beams 14 are set back with respect to the projections 20, 21 in such a way that the end plates 26 are located a slight distance behind the ends of the depressions 22. FIG. 4 illustrates this in particular.

Figure 5:
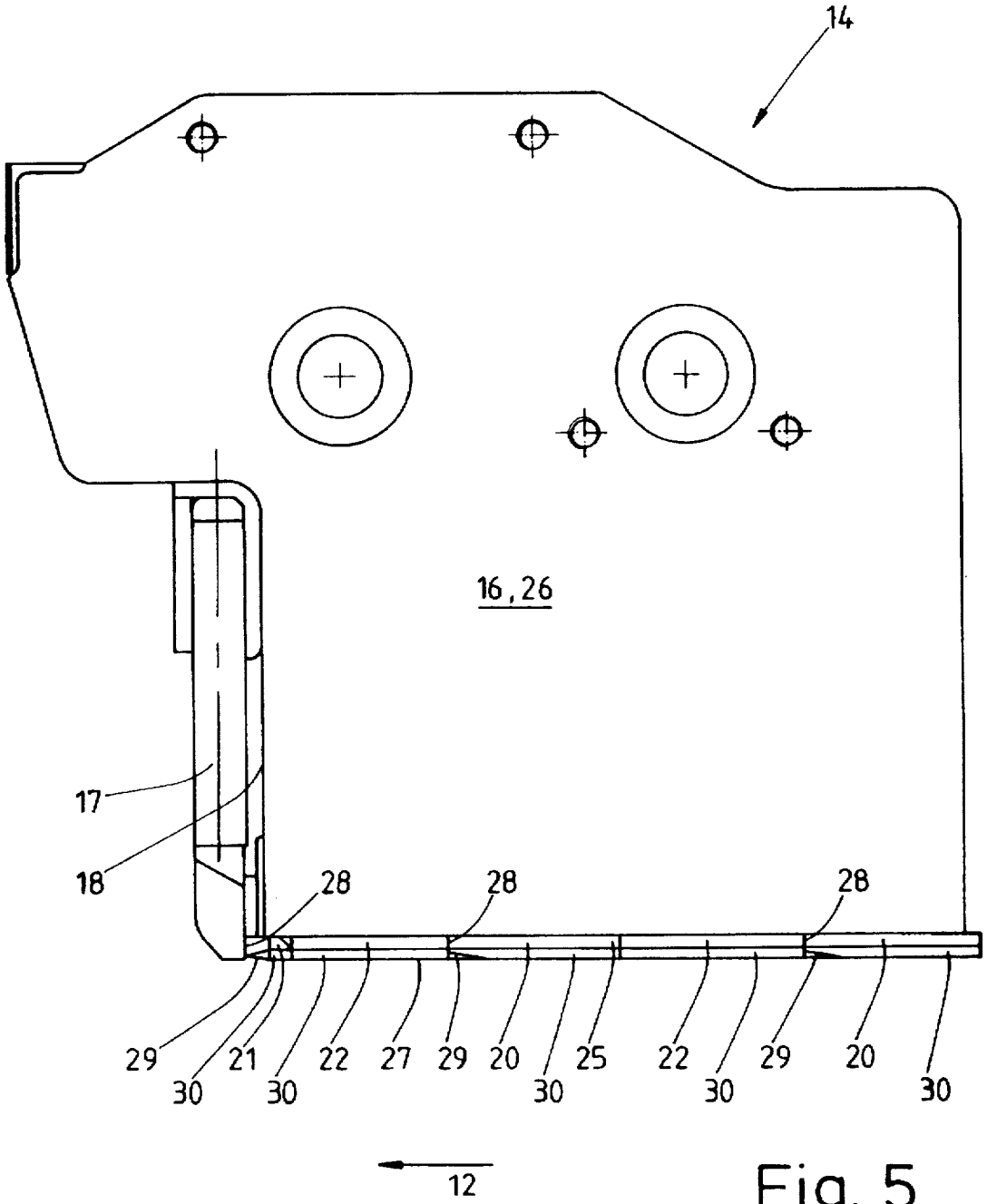
FIG. 5 shows an enlarged side view V towards an inner end face of a shifting beam according to FIG. 3.

The successive projections 20, 21 of the shifting beams 14 are located in the plane of the base plate 25, which may, if appropriate, run slightly inclined to the horizontal, to be precise in such a way that it rises sightly in the working direction 12. Therefore, according to FIG. 5, the undersides of the projections 20, 21 finish flush with an underside 27 of the base plate 25 of the respective shifting beam 14. The lower edges, lying at the front in the working direction 12, of the front sides 28, running transversely to the working direction 12, of the projections 20, 21 are provided with bevels 29. These bevels 29 run in an obliquely downwardly directed manner counter to the working direction 12. The ends of the bevels 29 merge seamlessly with the undersides of the projections 20, 21. This achieves the effect that road building material projecting between successive projections 20, 21 in the regions of the depressions 22 can pass from the bevel 29 of the following projection 20 or 21 to the underside 27 of the base plate 25, thus underneath the shifting beams 14. Furthermore, the longitudinal edges of the projections 20, 21 and of the depressions 22, running parallel to the longitudinal centre axis 24 of the laying beam 10, are provided with bevels 30. The edges which cannot be seen in FIG. 4 of all the bevels 29 and 30 are indicated by dashed lines.

The laying beam 10 is usually heated. The heating of the shifting beams 14 takes place by the base plates 25 being heated from the body of the shifting beam 14 located above the respective base plate 25. Since the projections 20, 21 project freely with respect to the bodies of the shifting beams 14, that is the inner end plates 26 of the same, the projections 20, 21 are separately heated. There preferably takes place a direct flame heating of the projections 20, 21 from channels arranged in the end plates 26.

What is claimed is:

1. A laying beam (10) for a road finisher (11), said beam (10) having a main beam (13), arranged on the road finisher (11), and two shifting beams (14) which can be shifted with respect to the main beam (13) transversely to a longitudinal working direction (12) of the road finisher (11), characterized in that the two shifting beams (14) have confronting end faces (19) which have respective projections (20, 21), and in that each projection (20, 21) of one of said two shifting beams (14) is offset with respect to a corresponding projection (20, 21) of the other shifting beam (14).

2. The laying beam according to claim 1, characterized in that each of the two shifting beams has depressions between said projections, and in that the projections (20, 21) of each of the two shifting beams (14) engage in corresponding ones of said depressions (22) of the other of the two shifting beams (14).

3. Laying beam according to claim 2, characterized in that the depressions (22) are slightly larger than the projections (20, 21).

4. Laying beam according to claim 2, characterized in that each depression (22) is bounded by oppositely lying projections (20, 21).

5. The laying beam according to claim 2, characterized in that each shifting beam has a lower base plate (25), and in that the projections (20, 21) and depressions (22) extend merely over the lower base plate (25) of each of the two shifting beams (14).

6. Laying beam according to claim 2, characterized in that the projections (20, 21) and depressions (22) have a substantially rectangular base area.

7. Laying beam according to claim 1, characterized in that alongside each projection (20, 21) of each shifting beam (14) there is arranged at least one depression (22) in each case.

8. Laying beam according to claim 1, characterized in that each projection (20, 21) of the one shifting beam (14) is offset in such a way with respect to each projection (20, 21) of the other shifting beam (14) that each projection (20, 21) of the one shifting beam (14) engages in a respective depression (22) of the other shifting beam (14).

9. The laying beam according to claim 1, characterized in that each shifting beam (14) has a width which is greater than half a width of the main beam (13).

10. The laying beam according to claim 1, characterized in that the projections (20, 21) have a length, extending transversely to the working direction (12), which corresponds approximately to twice an overlap of a respective extended shifting beam (14) and the main beam (13).

11. Laying beam according to claim 1, characterized in that each shifting beam (14) has a plurality of said projections (20, 21), following one another at intervals, and depressions (22) arranged next to the projections (20, 21).

12. The laying beam according to claim 1, characterized in that each of a front side and a rear side of each shifting beam (14) has one of said projections (20, 21).

13. The laying beam according to claim 12, characterized in that the projection (21) on the front side of at least one shifting beam (14) is narrower than other projections (20) of said at least one shifting beam (14).

14. The laying beam according to claim 1, characterized in that one shifting beam (14) has an offset with respect to the other shifting beam (14) in the working direction (12) of the road finisher (11).

15. The laying beam according to claim 14, characterized in that the shifting beams (14) are offset in such a manner to form, between the two shifting beams, an offset that corresponds to a width of a narrow front one of said projections (21) of the one shifting beam (14) and to a width of a tamper blade (17) adapted to be arranged in front of said narrow front projection (21).

16. The laying beam according to claim 1, characterized in that the shifting beams (14) have confronting end plates (26) which are arranged on said confronting end faces (19) of the shifting beams (14), and which are set back with respect to the projections (20, 21).

17. Laying beam according to claim 16, characterized in that the end plates (26) of the shifting beams (14) are set back with respect to the projections (20, 21) at least by a length of the depressions (22).

18. The laying beam according to claim 1, characterized in that undersides (27) of all the projections (20, 21) of each shifting beam (14) lie in a common plane.

19. The laying beam according to claim 18, characterized in that said common plane rises slightly in said working direction (12) of the road finisher (11).

20. The laying beam according to claim 1, characterized in that the projections (20, 21) have from sides (28) which may transversely to the working direction (12) of the road finisher (11), and which are provided with bevels (29) rising in the working direction (12) of the road finisher (11).

21. Laying beam according to claim 1, characterized in that the projections (20, 21) are separately heatable.

* * * * *